US011469071B2

(12) United States Patent
Behling et al.

(10) Patent No.: US 11,469,071 B2
(45) Date of Patent: Oct. 11, 2022

(54) ROTARY ANODE FOR AN X-RAY SOURCE

(71) Applicant: KONINKLIJKE PHILIPS N.V., Eindhoven (NL)

(72) Inventors: Rolf Karl Otto Behling, Norderstedt (DE); Christoph Helmut Bathe, Hamburg (DE); Wolfgang Chrost, Hamburg (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/770,979

(22) PCT Filed: Dec. 11, 2018

(86) PCT No.: PCT/EP2018/084350
§ 371 (c)(1),
(2) Date: Jun. 9, 2020

(87) PCT Pub. No.: WO2019/115519
PCT Pub. Date: Jun. 20, 2019

(65) Prior Publication Data

US 2020/0388461 A1 Dec. 10, 2020

(30) Foreign Application Priority Data

Dec. 11, 2017 (EP) ..... 17206337

(51) Int. Cl.
*H01J 35/10* (2006.01)

(52) U.S. Cl.
CPC ..... *H01J 35/105* (2013.01); *H01J 35/104* (2019.05); *H01J 35/108* (2013.01); *H01J 2235/1295* (2013.01)

(58) Field of Classification Search
CPC ..... H01J 35/00; H01J 35/10; H01J 35/105; H01J 35/104; H01J 35/108;
(Continued)

(56) References Cited

U.S. PATENT DOCUMENTS 3,982,148 A 9/1976 Kaplan et al.
4,103,198 A 7/1978 Braun
(Continued)

FOREIGN PATENT DOCUMENTS

WO WO2012004253 A1 1/2012

OTHER PUBLICATIONS

PCT International Search Report, International application No. PCT/EP2018/084350 dated Feb. 18, 2019.

*Primary Examiner* — Jurie Yun
(74) *Attorney, Agent, or Firm* — Larry Liberchuk

(57) ABSTRACT

The rotatable anode of a rotating anode X-ray source has demanding requirements placed upon it. For example, it may rotate at a frequency as high as 200 Hz. X-ray emission is stimulated by applying a large voltage to the cathode, causing electrons to collide with the focal track. The focal spot generated at the electron impact position may have a peak temperature between 2000° C. and 3000° C. The constant rotation of the rotating anode protects the focal track to some extent, however the average temperature of the focal track immediately following a CT acquisition protocol may still be around 1500° C. Therefore, demanding requirements are placed upon the design of the rotating anode. The present application proposes a multi-layer coating for the target region of a rotating X-ray anode which improves mechanical resilience and thermal resilience, whilst reducing the amount of expensive refractory metals required.

15 Claims, 5 Drawing Sheets

(58) Field of Classification Search
CPC ..... H01J 2235/1295; H01J 2235/084; H01J 2235/085; H01J 2235/1291
See application file for complete search history.

(56) References Cited

U.S. PATENT DOCUMENTS

| | | | | | |
|---|---|---|---|---|---|
| 4,298,816 | A | | 11/1981 | Hirsch et al. | |
| 4,799,250 | A | * | 1/1989 | Penato | H01J 35/108 378/144 |
| 5,148,463 | A | * | 9/1992 | Woodruff | H01J 35/108 378/125 |
| 5,577,263 | A | | 11/1996 | West | |
| 5,943,389 | A | | 8/1999 | Lee | |
| 5,993,280 | A | | 11/1999 | Rodhammer et al. | |
| 9,911,570 | B2 | * | 3/2018 | Tiwari | H01J 35/18 |
| 2007/0207338 | A1 | | 9/2007 | McKechnie et al. | |

* cited by examiner

RELATED ART

RELATED ART

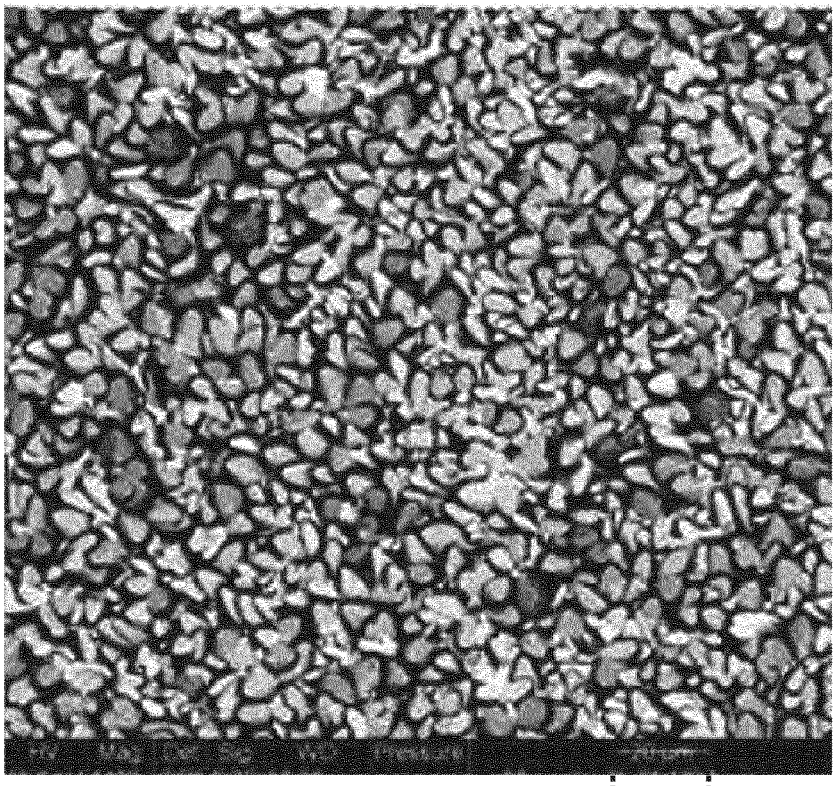
Fig. 5a) =20μm
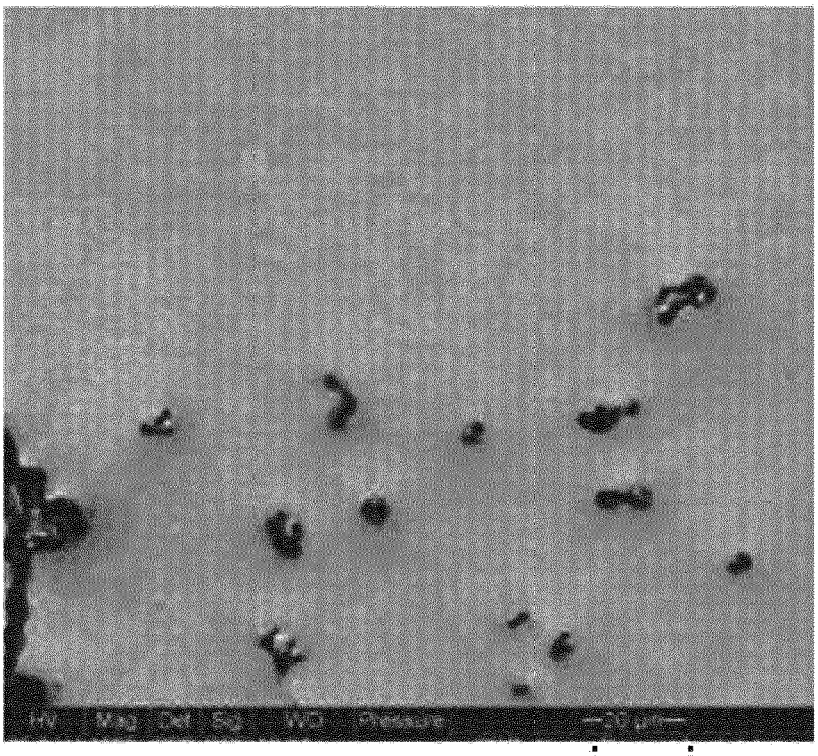
Fig. 5b) =20μm

ROTARY ANODE FOR AN X-RAY SOURCE

FIELD OF THE INVENTION

The present invention relates to a rotatable anode for a rotating anode X-ray source, a rotary anode X-ray tube, and a method of manufacturing a rotatable anode.

BACKGROUND OF THE INVENTION

A rotatable anode X-ray tube comprises a cathode aligned with a focal track on a rotatable anode disk, all enclosed in an evacuated glass envelope. In operation, the rotatable anode rotates at a frequency as high as 200 Hz. X-ray emission is stimulated by applying high voltage to the cathode, causing electrons to collide with the focal track. The focal spot generated at the electron impact position may have a peak temperature between 2000° C. and 3000° C. The constant rotation of the rotating anode protects the focal track to some extent, however the average temperature of the focal track immediately following a CT acquisition protocol may still be around 1500° C. Therefore, demanding requirements are placed upon the design of the rotating anode.

U.S. Pat. No. 3,982,148 discusses the use of rhenium as a rough heat radiating coating of a rotatable X-ray anode. Such rotatable anodes may, however, be further developed.

SUMMARY OF THE INVENTION

The objective of the present invention is solved by the subject-matter of the appended independent claims, wherein further embodiments are incorporated in the dependent claims.

According to a first aspect, there is provided a rotatable anode for a rotating-anode X-ray source, comprising:

a substrate; and a target region formed on the substrate.

The target region comprises a multi-layer coating comprising a first layer of a first material deposited on a surface of the substrate, and a second layer of a second material deposited on the surface of the first layer. A thickness ratio between the first and second layers of the multi-layer coating in the target region is in the range 0.5 to 2.0.

The first material has a greater mechanical resilience compared to the second material, and the second material is more thermally conductive compared to the first material.

Accordingly, the first material in the multi-layer coating has an increased resistance to tensile stress, and the second material in the multi-layer coating can more effectively dissipate heat in the target area generated by the focal spot, as compared to the first material, allowing the multi-layer coating of the rotatable anode enables the surface of the rotatable anode to be optimised for two different characteristics, for example good thermal performance, and good mechanical stress and/or smoothness performance.

During manufacture, the application of multiple material layers to a rotatable anode at a high temperature (for example, around 800° C.) implies that, during cooling of the rotatable anode after the application of the multiple material layers, there will be different coefficients of thermal expansion in the different material layers, leading to increased stress in the rotatable anode. It is proposed to control the thickness ratio between the first and second layers of the multilayer coating carefully, in order to reduce the residual material stress in such a treated rotatable anode.

The synergetic effect of the multiple material layers (improved mechanical resilience with improved thermal dissipation) means that thinner individual material layers are needed. Typically, the rotary anode is the most expensive component of a rotating anode X-ray source. Reducing the thickness of material layers (typically composed of expensive refractory metals) reduces the overall cost of manufacturing the anode.

Multiple material layers improve the performance of the rotatable anode in operation. The operation of a rotatable anode in a CT scanner can generate a high stress level in the circumferential direction at the outer diameter of the rotatable anode (known as pressure stress) and the inner diameter (known as tensile stress). This is caused by a combination of the high thermal gradient in the region of the focal track, combined with the various coefficients of thermal expansion of the first and second material.

Typically, a metal coating suffers from plastic deformation, resulting in residual tensile stress in the coating after the rotatable anode has cooled down. This tensile stress is transferred to the surface of the rotatable anode. A rotatable anode having a target region (focal track) comprising a multi-layer coating with at least two layers having a thickness ratio between them in the range 0.5 to 2 will reduce the residual tensile stress.

Optionally, the thickness ratio between the first layer and second layer in the target region is in the range of 0.95 to 1.05.

Accordingly, a multi-layer coating is provided with at least two layers having an almost identical thickness, further improving the tensile strength performance.

Optionally, the total thickness of the first layer and the second layer is in the range of 5 um to 60 um. The provision of thin layers enables a CVD coating to be provided without additional machining. Experimental experience has revealed that a thick coating of up to one millimeter on the rotary anode results in an enhanced probability of the generation of initial cracks in the graphite after cooling down from CVD coating, due to the thermal coefficient of thermal expansion (CTE) mismatch between tungsten and graphite. Such cracks having a typical depth of up to 300 micrometres are absent with the proposed coating, such as, in one optional example, where a rhenium layer has a thickness of about 20 μm, and a tungsten layer has a thickness of about 20 μm.

Optionally, the first material is rhenium, tantalum, tantalum carbide, or tungsten carbide.

Accordingly, a multi-layer coating is provided having a refractory metal, or refractory metal alloy, in contact with the rotatable anode surface. The listed materials have an improved resistance to high tensile forces, for example. In addition, rhenium performs as a barrier to prevent overlying tungsten from carbonising at high temperature (owing to the migration of carbon from an underlying carbon anode surface).

Optionally, the second material is tungsten iridium or another refractory metal. Optionally, the second material is a tungsten-rhenium alloy. Optionally the second material is a tungsten-rhenium alloy in the ratios W99%-Re1%; W95%-Re5%; W90%-Re10%; or W85%-Re15%.

Accordingly, a material having improved heat conductivity is provided on the outermost layer of the multi-layer coating. The second material layer is directly exposed to the electron beam of the X-ray tube, and can reach temperatures in excess of 2500° C. Therefore, providing a heat resistant material as the second material improves the lifetime of the focal track, and enables heat to be dissipated more effectively. Optionally, the second material has a thermal conductivity of greater than 100 $Wm^{-1}$ $k^{-1}$.

Optionally, the second material is pure tungsten, and the second layer has a thickness in the range of 5 to 60 um.

Optionally, the surface of the second material in the target region has been smoothed by a thermal sintering process at a temperature of greater than 1500° C.

Accordingly, it is proposed to condition the target area of the rotatable anode at a temperature significantly higher than the usual temperature of operation, to stabilise the morphological structure of the second material.

Optionally, the surface of the second material in the target region has an average surface roughness (Ra) of lower than 5 um, as measured using, for example, an optical or tactile measuring device.

Optionally, the target region is provided as a first area of the rotatable anode, and a non-target region comprises a second area of the rotatable anode, the first layer of the first material additionally deposited on the surface of second area of the substrate. Accordingly, the second material is deposited, for example, only on the target area (focal track) on the rotatable anode. Thus, the target area has a smooth surface in comparison with areas of the rotatable anode outside of the target area. This means that the beneficial effects of a multi-layer coating, discussed above, are provided in respect of the target area (focal track), but that the areas of the rotatable anode which do not form the target area have a significantly rougher surface compared to the target area, and hence a significantly improved thermal radiation capability.

Optionally, the first area of the rotatable anode forming the target region is approximately at least 5%, or at least 10%, or at least 15% wider than the largest focal spot size, to provide a safety margin preventing the direct contact of the focal spot onto the first material layer, for example.

Optionally, the substrate is formed from carbon composite or graphite.

Accordingly, in the case of a carbon composite substrate, a rotating anode having a low mass is provided. Alternatively, a graphite rotating anode provides higher thermal capacity.

According to a second aspect, there is provided a rotary anode X-ray tube. The tube comprises:

an evacuated envelope;

a rotatable anode in accordance with the first aspect or its optional embodiments, supported on a rotary bearing contained within the evacuated envelope; and a cathode contained within the evacuated envelope, oriented, in operation, to accelerate electrons towards the rotatable anode to cause X-ray emission.

A rotary anode X-ray tube incorporating a rotatable anode according to the first aspect can be expected to have an improved lifetime, owing to the combined improved resistance of the focal track to tensile and thermal stress.

Optionally, the rotary bearing is a hydrodynamic bearing which comprises a liquid metal lubricant or is a sliding bearing A rotary anode X-ray tube incorporating a rotatable anode according to the first aspect has a multi-layer coating with a second layer which provides effective heat conduction. A liquid metal rotary bearing lubricant provides a lower thermal resistance to heat that must be conducted away from the rotary anode.

According to a third aspect, there is provided a method of manufacturing a rotatable anode, comprising:

a) providing a rotatable anode substrate;

b) depositing a first layer of a first material onto a surface of the substrate; and c) depositing a second layer of a second material on the surface of the first layer;

wherein a thickness ratio between the first and second layers in the target region is in the range 0.5 to 2.0. The first material has a greater mechanical resilience compared to the second material, and the second material is more thermally conductive compared to the first material.

Optionally, the method of manufacturing a rotatable anode according to the third aspect further comprises d) sintering the rotatable anode substrate with first and second layers by heating it to a temperature in the range of 1500° C. to 3200° C.

Accordingly, the target area (focal track) of a rotatable anode may be smoothed (sintered) using an electron beam method. The sintering approach optionally provides a maximal focal spot size (for example, through a "blooming" process having a low voltage and high current.

Optionally, exceeding the maximal allowed focal spot temperature during anode conditioning in the factory can stabilise the morphological structure of the multi-layer coating.

In the following application, the term "target region" refers to a substantially ring-shaped region close to the perimeter of a circular rotatable anode. In operation, the target region is bombarded by incident electrons emitted by a cathode arranged above the target region. In operation, a "focal spot" from which X-rays are emitted appears in the section of the "target region" underneath and/or immediately adjacent to the cathode.

In the following application, the term "multi-layer coating" defines a material covering on the surface of a rotatable anode having at least two distinct material layers. For example, a 25 μm thick layer of rhenium would be deposited on top of a substrate, and a 25 μm thick layer of tungsten would then be deposited on top of the rhenium layer. Of course, the term can also cover a plurality of repeating multi-layers, repeating such a first material layer (for example, of rhenium) and a second material layer (for example, tungsten) one, two, three, four, or more times.

In the following application, the term "thickness ratio" means the thickness of the first material layer divided by the thickness of the second material layer. In the context of the micron scale layers considered in this application, it is not essential that the "thickness" and/or "total thickness" of each layer is an absolute measurement, but may, for example, be a statistical measure of material layer thickness over a certain length of the target area. In the following application, the term "surface roughness" primarily means the average surface roughness (Ra, arithmetical mean height), as measured using an optical or tactile measuring device known to a person skilled in the art. However, other proxy measurements to surface roughness such as root mean square deviation (Rq), root mean square slope (Rq) and the like may also provide information useful for characterizing surface roughness, and the use of Ra is not limiting.

In the following application, the term "mechanical resilience" generally means the ability of a material to withstand an applied force. In the context of this application, the term may embrace the concept of a material having a higher or lower modulus of resilience—in other words, the maximum energy that can be absorbed by a material per unit volume without causing a long-lasting deformation in the material, as defined by the modulus of resilience.

In the following application the term "thermally conductive" refers to the ability of material to transfer thermal energy compared to another material. Typically, the heat conductivity is measured in W/(m·K), and may be used as one way to compare the ability of given material to transfer thermal energy. For example, the thermal conductivity of tungsten is about 120 W/(m·K). For example, the value of thermal conductivity for Re is about 50 W/(m·K).

In the following application, the condition "the first material has a greater mechanical resilience compared to the second material, and the second material is more thermally conductive compared to the first material" refers to the material properties as evaluated at room temperature (20 degrees Celsius).

It is, thus, a general idea of the application to provide a rotatable anode with at least two material layers having a similar thickness. The first layer (in contact with a substrate) functions to provide mechanical resilience, and the second layer (in contact with the first layer) functions to improve thermal performance of the rotatable anode.

These, and other aspects of the present invention will become apparent from, and elucidated with reference to the embodiments described hereinafter.

BRIEF DESCRIPTION OF THE DRAWINGS

Exemplary embodiments of the invention will be described with reference to the following drawings:

FIG. 5*a*) and 5*b*) show photographs of anode targets before and after a sintering process.

DETAILED DESCRIPTION OF EMBODIMENTS

Figure 1:
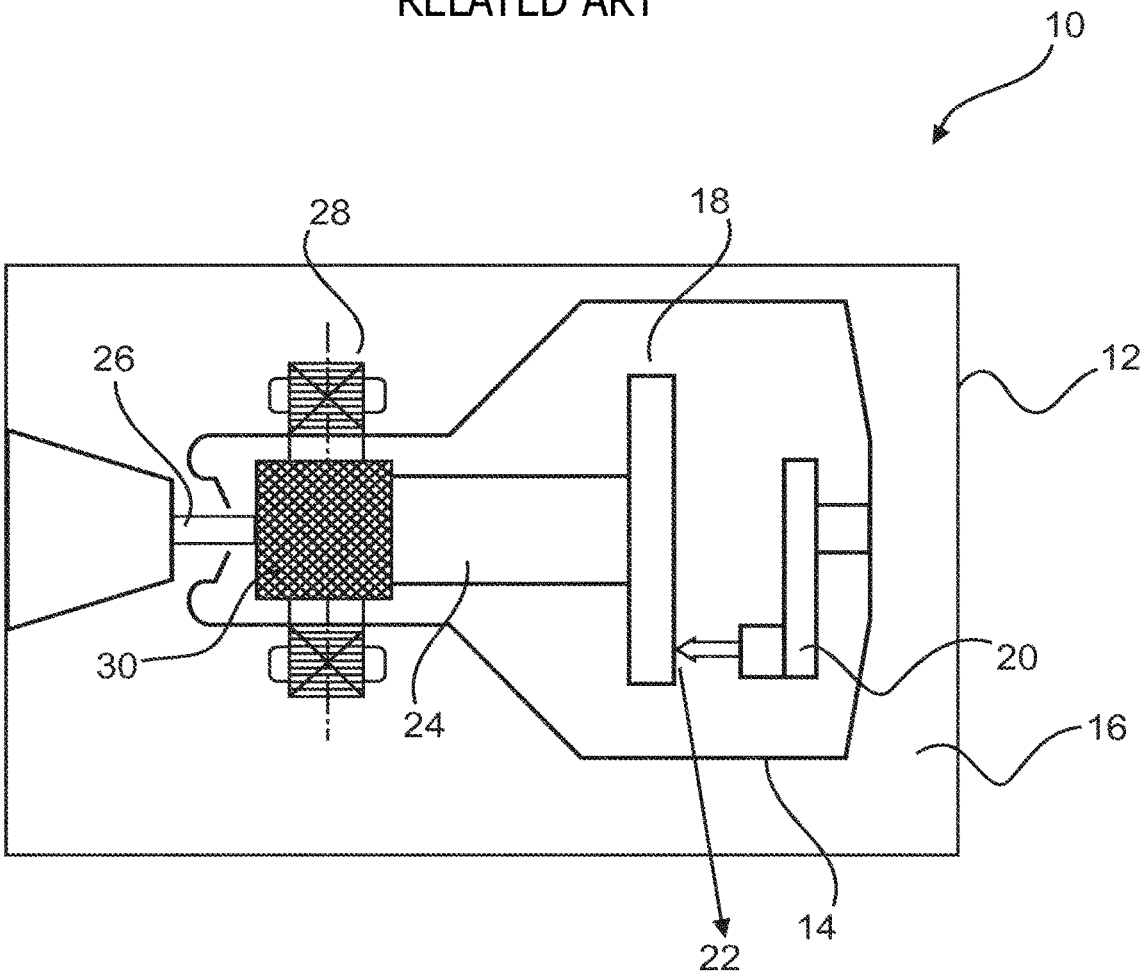
FIG. 1 shows a schematic view of a conventional rotating anode X-ray source.

FIG. 1 illustrates a conventional rotating anode X-ray tube 10. It comprises an external container 12 with a tube envelope 14 inside. A gap between the external container 12 and the tube envelope 14 is typically filled with an insulating fluid, such as oil. The tube envelope contains a rotatable anode disk 18, and a cathode 20 aligned with an outer perimeter of the rotatable anode disk 18. In operation, the cathode 20 emits electrons at high velocity towards the outer perimeter of the rotatable anode disk 18, and X-ray emission 22 out of the vacuum envelope occurs principally as bremsstrahlung emission. Only a small proportion of the high velocity electrons are converted into X-ray radiation, leaving the energy in the rest of the electron beam to be dissipated from the focal spot on the outer perimeter of the rotatable anode disk 18 as, typically, 50 kW to 100 kW of heat energy. For this reason, the rotatable anode disk 18 is rotated at frequencies as high as 200 Hz, to ensure that the target area (focal track) is not damaged by excessive heating.

In modern rotating anode X-ray tubes, a bearing system 24 is provided between an anode support shaft inside the tube envelope 14, and an outer rotor 26. Typically, this is a liquid metal bearing system to enable heat conduction from the rotatable anode disk 18 out of the vacuum envelope. Also present is a motor subsystem, comprising a stator 28 attached to the external container 12 and a rotor body 30 typically comprising a copper cylinder. In operation, energisation of the stator 28 causes the rotatable anode disk 18 to move around an axis defined by the bearing system 24.

Figure 2:
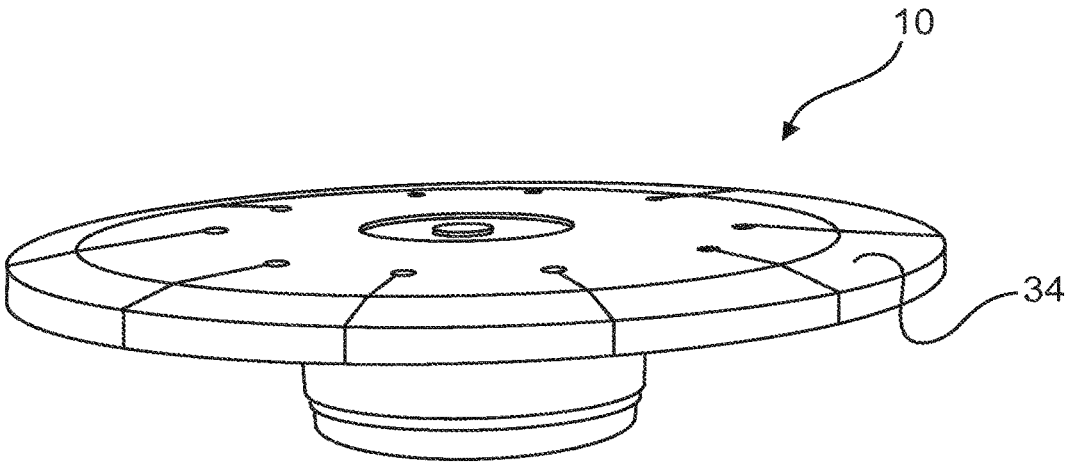
FIG. 2 shows a conventional rotating anode.

FIG. 2 illustrates a conventional X-ray rotating anode target 32. The illustrated target is a segmented all-metal anode bearing a focal track region 34 which may, for example, comprise a tungsten-rhenium alloy of 1 mm thickness as its top layer. However, the use of such a thick refractory metal alloy significantly increases the cost of such a rotary anode.

Furthermore, the use of rhenium as a rough heat radiating coating means that the granular structure of the rhenium coating is disadvantageous from a thermal perspective, as the lateral heat conductivity is diminished compared with the bulk material of the anode. Furthermore, the quality and amount of X-radiation, which is typically taken off the anode at a grazing angle, is worsened through intrinsic attenuation and beam filtration.

Figure 3A:
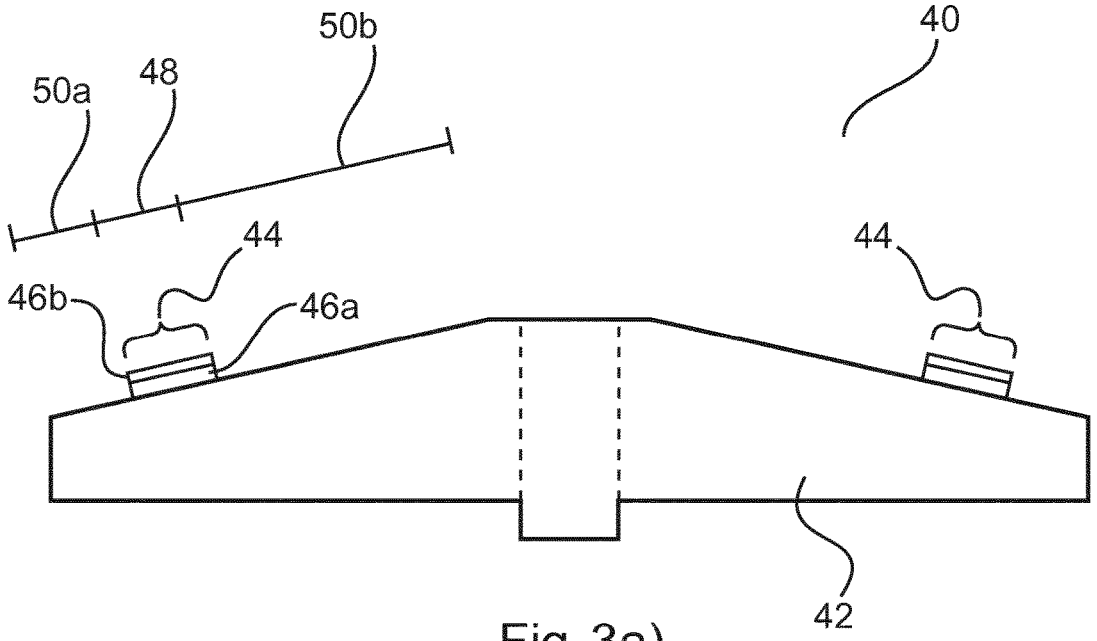
FIG. 3 a) and *b*) show embodiments of a rotatable anode in accordance with aspects discussed herein.

FIG. 3*a*) illustrates a schematic of a rotary anode according to a first aspect in a side cut-through view through the axis of rotation.

According to the first aspect, there is provided a rotatable anode 40 for a rotating-anode X-ray source, comprising:

a substrate 42; and a target region 44 formed on the substrate 42.

The target region comprises a multi-layer coating 46*a*, 46*b* comprising a first layer 46*a* of a first material deposited on a surface of the substrate 42, and a second layer 46*b* of a second material deposited on the surface of the first layer.

A thickness ratio between the first and second layers of the multi-layer coating in the target region is in the range 0.5 to 2.0.

More particularly, thickness ratio between the first layer 46*a* and the second layer 46*b* is in the range 0.95 to 1.05, or in the range 0.6 to 1.5, or in the range 0.75 to 1.25.

Optionally, the total thickness of the first layer 40*a* and the second layer 40*b* is in the range 5 μm to 60 μm, in the range 20 μm to 55 μm, or in the range 30 μm to 52.5 μm.

The target region is provided with a multi-layer coating comprising two materials which may be selected to have complimentary properties in operation. For example, the first material is a material having relatively high mechanical stability at high temperature and stress compared to the second material such as rhenium, tantalum, tungsten carbide, or tungsten carbide. Rhenium additionally functions as a diffusion barrier between a carbon anode substrate and the tungsten layer, for example.

The second material may, for example, be a material having a higher thermal conductivity compared to the first material, for example tungsten or iridium. Optionally, the second material is pure tungsten, and the second layer has a thickness in the range of 5 μm to 60 μm, 10 μm to 50 μm, 15 μm to 45 μm, 20 μm to 35 μm, 22.5 μm to 27.5 μm. FIG. 3*a*) illustrates an example schematic of a rotary anode according to an optional embodiment of the first aspect in a side cut-through view through the axis of rotation.

The target region 44 is provided as a first area 48 of the rotatable anode, and a non-target region 50*a*, 50*b* comprises a second area of the rotatable anode, the first layer of the first material additionally deposited on the surface of the second area of the substrate 42. In other words, a microscopic layer 46*a* of a first material (for example, rhenium) extends substantially over the focal track of the rotatable anode 42, and a second microscopic layer 46*b* of tungsten is provided on top of the layer of the first material in the target region (focal track).

Optionally, substrate 42 is formed from carbon composite or graphite.

Optionally, the surface of the second material is smoothed by a thermal sintering process at a temperature of optionally greater than 1500° C., greater than 2000° C., or greater than 2250° C., or greater than 2500° C. or greater than 2750° C.

Accordingly, after thermal sintering, the surface roughness of the second material in the target region may be lower than 5 μm, meaning that a further surface smoothing step (for example, performed by machining) is not required.

As a preferred embodiment, the first material is provided as a layer of pure rhenium having a thickness ranging between 20 μm to 25 μm, and the second material is provided as a layer of pure tungsten having a thickness ranging between 20 μm to 25 μm. Advantageously, the rhenium has superior mechanical performance to that of tungsten, and can perform as a diffusion barrier for carbon. The tungsten has a superior thermal performance compared to the rhenium, and functions to spread heat more quickly to areas of the focal track that are not in the direct instantaneous path of the electron beam. The relative thinness of both of the rhenium and tungsten layers (when compared with the typical case of a 1 mm thick rhenium layer, for example) means that tensile stresses caused by thermal expansion and contraction are minimized, compared to the use of thicker rhenium and/or tungsten layers. Furthermore, cracks appear less quickly, compared to conventional all-rhenium surfaces.

From a metallurgical perspective, the microscopic surface of rhenium comprises many irregularities which protrude tens of μm from the substrate surface (seen, for example, in FIG. 5*a*. The use of tungsten as a second material layer enables the tungsten to "spread" around the protrusions of rhenium, improving the smoothness of the rotary anode. Optionally, the target region 44 is provided as a first area 48 of the rotatable anode, and a non-target region 50 *a*, 50*b* comprises a second area of the rotatable anode.

Figure 3B:
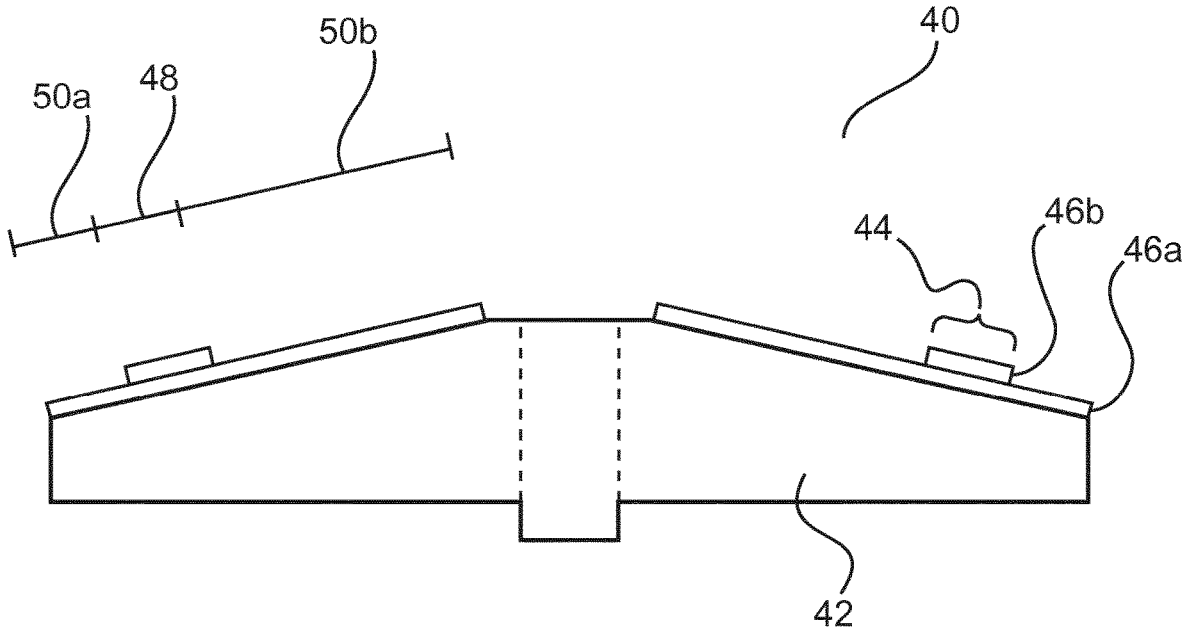

FIG. 3*b*) illustrates a schematic side-view of a rotary anode according to an optional embodiment of the first aspect in a cut-through view through the axis of rotation. In FIG. 3*b*), reference numerals are common to FIG. 3*a*), where appropriate.

Optionally, and as illustrated in FIG. 3*b*), the target region 44 is provided as a first area 48 of the rotatable anode, and a non-target region 50*a*, 50*b* comprises a second area of the rotatable anode, the first layer of the first material additionally deposited on the surface of the second area of the substrate 42. In other words, a microscopic layer 46*a* of a first material (for example, rhenium) extends substantially over the entire upper surface of the rotatable anode 42, and a second microscopic layer 46*b* of tungsten is provided in the target region (focal track). Advantageously, the roughened surface of the rhenium exposed in the non-target region is a better heat radiator than the bare anode substrate.

Optionally, the target region 44 extends into the non-target region by 5%, 10%, or 15% of the width of a focal spot to provide a safety margin, such that the microscopically thin rhenium layer is not damaged by direct exposure to the electron beam.

According to a second aspect, there is provided a rotary anode X-ray tube comprising:

an evacuated envelope;

a rotatable anode in accordance with the first aspect or its embodiments supported on a rotary bearing contained within the evacuated envelope; and a cathode contained within the evacuated envelope, oriented, in operation, to accelerate electrons towards the rotatable anode to cause X-ray emission.

The manufacture of a rotatable anode will now be discussed.

Figure 4:
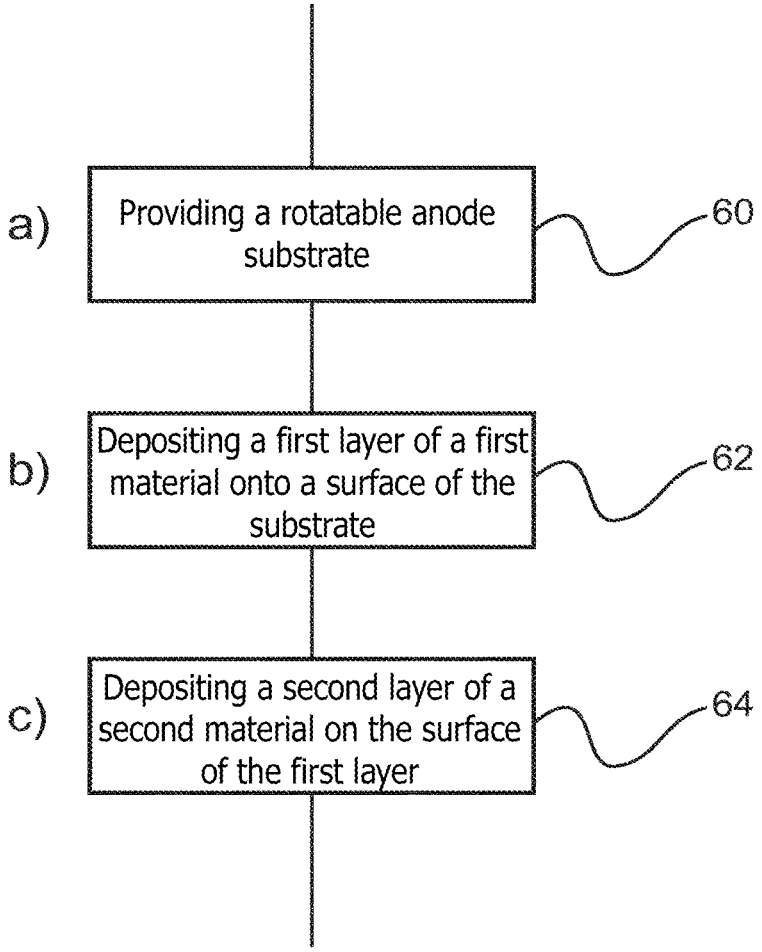
FIG. 4 illustrates a manufacturing process in accordance with a third aspect of the invention.

FIG. 4 illustrates a process for manufacturing a rotatable anode according to the first aspect.

The method of manufacturing a rotatable anode, comprises:

a) providing 60 a rotatable anode substrate;

b) depositing 62 a first layer of a first material onto a surface of the substrate; and c) depositing 64 a second layer of a second material on the surface of the first layer. The thickness ratio between the first and second layers in the target region is in the range 0.5 to 2.0.

Step a) of providing a rotatable anode substrate optionally comprises obtaining a circular carbon (carbon felt or composite) or graphite blank and placing it in a suitable chemical vapour deposition (CVD) reaction chamber.

Step b) comprises the deposition, for example by chemical vapour deposition, of a first layer of a first material on the substrate blank, to generate a substrate intermediate. Optionally, the first material is rhenium, optionally deposited to a thickness of 25 μm. Following the deposition of the first material, the CVD reaction chamber is purged in preparation for subsequent step.

Although CVD has been referred to above, any suitable material deposition approach may be used in the manufacturing method. For example, pulsed laser deposition (PLD), plasma spraying (PS), physical vapour deposition, and electroplating are provided as nonlimiting examples of other manufacturing techniques applicable in steps a) and b).

Step c) comprises the deposition, for example by chemical vapour deposition, of a second layer of a second material on the substrate intermediate. Optionally, the second material is tungsten, optionally deposited to a thickness of 25 μm.

Typically, there are intermediate steps of masking the substrate or substrate intermediate, to ensure that the first and second materials are deposited only on a target region (focal track). Optionally, the masking step is not applied before step b), such that a microscopic rhenium layer is provided across a substantially the whole upper surface of the anode blank.

Optionally, there is provided the step d) of sintering the rotatable anode substrate by heating it to a temperature in the range of 1500° C. to 3200° C., preferably to 1800° C. The effect of the sintering operation is to smooth the surface of the second material. Typically, sintering may be performed using an electron beam (optionally, the electron beam of the X-ray tube itself, before degassing and vacuum evacuation). Effectively, during manufacture, the focal track is smoothed by generating a focal spot having a temperature significantly higher than the focal spot applied during normal operation of the rotary anode.

Step d) is effectively a "break-in process" that can be combined with the tube anode heat testing step performed by a tube anode manufacturer. However, over driving the focal spot temperature during the break-in process enables the surface of the target region to have a low roughness.

Optionally, an unsintered area of the coating has a maximum roughness (Ra) of around 10 μm and a sintered area of the coating has a maximum roughness of around Ra=4 μm.

FIG. 5*a*) and 5*b*) are images of, respectively, a pure rhenium CVD coating before (FIG. 5*a*) and after (FIG. 5*b*) the thermal sintering process of step d). As shown, before processing, the rhenium surface is relatively rough, whereas following the thermal sintering treatment, the rhenium surface is smoother.

It should to be noted that embodiments of the invention are described with reference to different subject-matters. In particular, some embodiments are described with reference to method-type claims, whereas other embodiments are described with reference to device-type claims. However, a person skilled in the art will gather from the above, and the following description that, unless otherwise notified, in addition to any combination of features belonging to one type of subject-matter, other combination between features relating to different subject-matters is considered to be disclosed with this application.

All features can be combined to provide a synergetic effect that is more than the simple summation of the features.

While the invention has been illustrated and described in detail in the drawings and foregoing description, such illustration and description are to be considered illustrative or exemplary, and not restrictive. The invention is not limited to the disclosed embodiments. Other variations to the disclosed embodiments can be understood, and effected by those skilled in the art in practicing the claimed invention, from a study of the drawings, the disclosure, and the dependent claims.

In the claims, the word "comprising" does not exclude other elements or steps, and the indefinite article "a" or "an" does not exclude a plurality. A single processor, or other unit, may fulfil the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A rotatable anode for a rotating-anode X-ray source, comprising:

a substrate; and a target region formed on the substrate;

wherein the target region comprises a multi-layer coating comprising a first layer of a first material deposited on a surface of the substrate, and a second layer of a second material deposited on the surface of the first layer, wherein the total thickness of the first layer and the second layer is between approximately 5 μm to 60 μm;

wherein a thickness ratio between the first and second layers of the multi-layer coating in the target region is between approximately 0.5 to 2.0; and wherein the first material has a greater modulus of resilience compared to the second material, and the second material is more thermally conductive compared to the first material.

2. The rotatable anode according to claim 1, wherein the thickness ratio between the first layer and the second layer in the target region is between approximately 0.95 to 1.05.

3. The rotatable anode according to claim 1, wherein the first material is one of rhenium, tantalum, tantalum carbide, and tungsten carbide.

4. The rotatable anode according to claim 1, wherein the second material is one of tungsten, iridium, and a tungsten-rhenium alloy.

5. The rotatable anode according to claim 4, wherein the second material is pure tungsten.

6. The rotatable anode according to claim 1, wherein the surface of the second material in the target region is smoothed by a thermal sintering process at a temperature of greater than approximately 1500° C.

7. The rotatable anode according to claim 6, wherein the surface of the second material in the target region has a surface roughness lower than approximately 5 um.

8. The rotatable anode according to claim 1, wherein the target region is provided as a first area of the rotatable anode, and a non-target region comprises a second area of the rotatable anode, the first layer of the first material additionally deposited on the surface of the second area of the rotatable anode.

9. The rotatable anode according to claim 1, wherein the substrate is formed from a carbon composite or a graphite.

10. A rotary anode X-ray tube, comprising:

an evacuated envelope;

a rotatable anode comprising:

a substrate; and a target region formed on the substrate, wherein the target region comprises a multi-layer coating comprising a first layer of a first material deposited on a surface of the substrate, and a second layer of a second material deposited on the surface of the first layer, wherein the total thickness of the first layer and the second layer is between approximately 5 μm to 60 μm, wherein a thickness ratio between the first and second layers of the multi-layer coating in the target region is between approximately 0.5 to 2.0, and wherein the first material has a greater modulus of resilience compared to the second material, and the second material is more thermally conductive compared to the first material; and a cathode contained within the evacuated envelope, oriented to accelerate electrons towards the rotatable anode to cause X-ray emission.

11. The rotary anode X-ray tube according to claim 10, further comprising a hydrodynamic bearing, wherein the hydrodynamic bearing comprises a liquid metal lubricant, or a sliding bearing.

12. The rotary anode X-ray tube according to claim 10, wherein the surface of the second material in the target region is smoothed by a thermal sintering process at a temperature of greater than approximately 1500° C.

13. A method of manufacturing a rotatable anode, comprising:

providing a rotatable anode substrate;

depositing a first layer of a first material onto a surface of the substrate; and depositing a second layer of a second material on the surface of the first layer, wherein the total thickness of the first layer and the second layer is between approximately 5 μm to 60; μm;

wherein a thickness ratio between the first and second layers in a target region is between approximately 0.5 to 2.0; and wherein the first material has a greater modulus of resilience compared to the second material, and wherein the second material is more thermally conductive compared to the first material.

14. The method of manufacturing according to claim 13, further comprising:

sintering the rotatable anode substrate with the first and second layers by heating to a temperature between approximately 1500 to 3200° C.

15. The method of manufacturing according to claim 13, further comprising:

sintering the rotatable anode substrate with the second layer by heating to a temperature greater than approximately 1500° C.

* * * * *